United States Patent [19]

Hatta et al.

[11] Patent Number: 4,589,779

[45] Date of Patent: May 20, 1986

[54] MULTI-ALARM TIMEPIECE WITH SIMPLIFIED OPERATING MEANS

[75] Inventors: Koichi Hatta, Yamatokoriyama; Yutaka Ikemoto, Nara, both of Japan

[73] Assignee: Sharp Kabushiki Kaisha, Osaka, Japan

[21] Appl. No.: 475,157

[22] Filed: Mar. 14, 1983

[30] Foreign Application Priority Data

Mar. 15, 1982 [JP] Japan ..... 57-41366
Mar. 17, 1982 [JP] Japan ..... 57-43293

[51] Int. Cl.[4] ..... G04B 23/02

[52] U.S. Cl. ..... 368/74; 368/63; 368/261; 368/187; 368/246

[58] Field of Search ..... 368/74, 246, 248, 251, 368/261, 262, 263, 63, 267, 245, 82, 187

[56] References Cited

U.S. PATENT DOCUMENTS 990,573 4/1911 Lux ..... 368/248
4,301,524 11/1981 Koepp et al. ..... 368/251
4,368,989 1/1983 Kawashima ..... 368/74
4,379,641 4/1983 Maezawa et al. ..... 368/261

FOREIGN PATENT DOCUMENTS 57-59192 9/1982 Japan ..... 368/63

OTHER PUBLICATIONS

Brochure, "Admiral Clock Radio Operating Instructions", 5/59, Form #41C20-298.

*Primary Examiner*—Bernard Roskoski
*Attorney, Agent, or Firm*—Birch, Stewart, Kolasch & Birch

[57] ABSTRACT

An electronic timepiece is disclosed which simplifies operations otherwise needed for executing a variety of functions. The electronic timepiece is characterized in that any desired alarm message may be activated by an extremely simple key operation. In addition, the alarm message timepiece can automatically set time data corresponding to respective alarm messages all at once when a battery is loaded therein.

2 Claims, 10 Drawing Figures

| BM \ BL | 15 | 14 | 13 | 12 | 11 | 10 | 9 | 8 | 7 | 6 | 5 | 4 | 3 | 2 | 1 | 0 |
|---|---|---|---|---|---|---|---|---|---|---|---|---|---|---|---|---|
| 0 | | | | | | | | $T_{10H}$ | $T_{1H}$ | $T_{10M}$ | $T_{1M}$ | $T_{10S}$ | $T_{1S}$ | | | |
| 1 | | | | | | | | $D_{10H}$ | $D_{1H}$ | $D_{10M}$ | $D_{1M}$ | $D_{10S}$ | $D_{1S}$ | | | |
| 2 | | | | | | | | | | | | | | | | |
| 3 | | | | | | | | | | | | | | | | |
| 4 | | | | | | | | | | | | | | | | |
| 5 | | | | | | | | | | | | | | | | |

T, D, V, X, Y, Z

MULTI-ALARM TIMEPIECE WITH SIMPLIFIED OPERATING MEANS

BACKGROUND OF THE INVENTION

The present invention relates to an electronic timepiece incorporating simplified functions and improved operational conveniences for users. In reference to electronic timepiece, such a multi-alarm message timepieces capable of verbally outputting a selected alarm message at a set time is well known. A conventional multi-alarm message timepiece is designed so that any desired alarm message can be input by operating a variety of keys, and therefore, it is advantageous to allow any message to be internally stored. It is however still inconvenient to store such alarm messages since a variety of keys must be selectively operated to input any desired alarm message for limited and pre-determined uses is contained.

In addition, such existing multi-alarm message timepieces are designed in such a manner so that the time setting mode is first entered by operating the mode select switch to correct the time, then any desired time must be set by operating the time correction key, and finally one must operate the entry key so that the time counting operation can be started from the moment when the time is corrected.

When using such an existing multi-alarm message timepiece of the prior art, a variety of keys must unavoidably be operated to start the time counting operation from the time being corrected, and in addition, after a certain time is specifically set, any of the mode select switches may be incorrectly pressed instead of the intended entry key.

OBJECT AND SUMMARY OF THE INVENTION

The present invention primarily aims to provide an electronic timepiece capable of simplifying operations needed for implementing a variety of the timewise functions so that a variety of existing problems caused by the conventional timepieces can be eliminated.

A further object of the present invention is to provide a multi alarm message clock capable of inputting any desired alarm message by means of an extremely simple key operation in such a case where the object of the use is limited and the pre-determined alarm message can be held unchanged.

Another feature of the present invention is characterized in that the talking alarm timepiece embodied by the present invention incorporates a function capable of determining whether any of the alarm messages being input by operating the alarm On/Off key should be verbally output. The other feature of the present talking alarm timepiece is characterized in that it incorporates a function capable of automatically setting the time data corresponding to each alarm message all at once when the battery is loaded into it.

A still further object of the present invention is to provide an electronic timepiece capable of automatically starting the time counting as soon as the normal mode is brought back after setting the actual time without using the entry key.

DETAILED DESCRIPTION OF THE INVENTION

Figure 1:
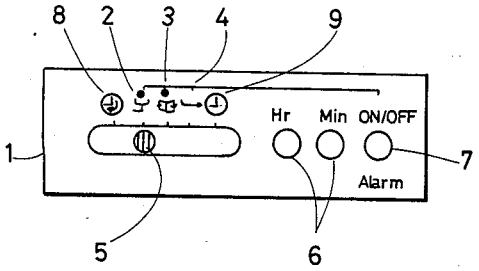
FIG. 1 shows the operation keyboard of the multi-alarm message timepiece of a preferred embodiment of the present invention.

FIG. 1 shows the operation keyboard of the multi-alarm message timepiece of a preferred embodiment of the present invention. The multi-alarm message timepiece embodied by the present invention comprises three-stage alarm modes audibly and verbally reporting, example, the wake-up, study, and sleep time. As shown in FIG. 1, the operation keyboard is provided with the wake-up symbol 2, study symbol 3, and the sleep symbol 4, which are sequentially arranged in the direction of the movement of the symbol select key 5 which comprises a slide switch. The time keys (hour and minute) 6 sets a specific alarm time. Alarm On/Off key 7 turns the preset alarm message On and Off. Symbol 9 associated with the symbol select key 5 indicates the Normal mode.

If the symbol select key 5 is set to the position of the wake-up symbol 2, the wake-up time can be set by operating the time key 6, and then the alarm-On mode is entered by operating the alarm On/Off key 7. When the designated time comes, a preset melody is first output, and then an alarm messsage such as "Good morning, it's (six thirty)" is verbally output.

Likewise, if the symbol select key 5 is set to the position of either the study symbol 3 or sleep symbol 4, and then both the alarm time is set and the alarm-On mode is executed, when the designated time comes, an alarm message such as a combination of either the "chime—a verbal message saying "it's high time to study'-'—melody" or the "chime—a verbal message "it's high time to go to bed"—melody", can be selectively output.

Such an alarm effect can be multiplied by repeating the verbal message at certain intervals, for example, 3 or 5 minutes later, if a person is still snoozing, the alarm message can also urge him by saying "get up now" and may add "don't be lazy, you'll be late for school or office".

Such an alarm message clock can serve more effectively by embodying a system capable of functioning as follows. For example, when the study mode is entered, the alarm message will first talk to a student by saying "it's high time to study". If he does not confirm the study time by correctly actuating the alarm key, on every hour and half-hour the alarm message will remind him of his negligence by saying "have you already finished your study?".

Figure 2:
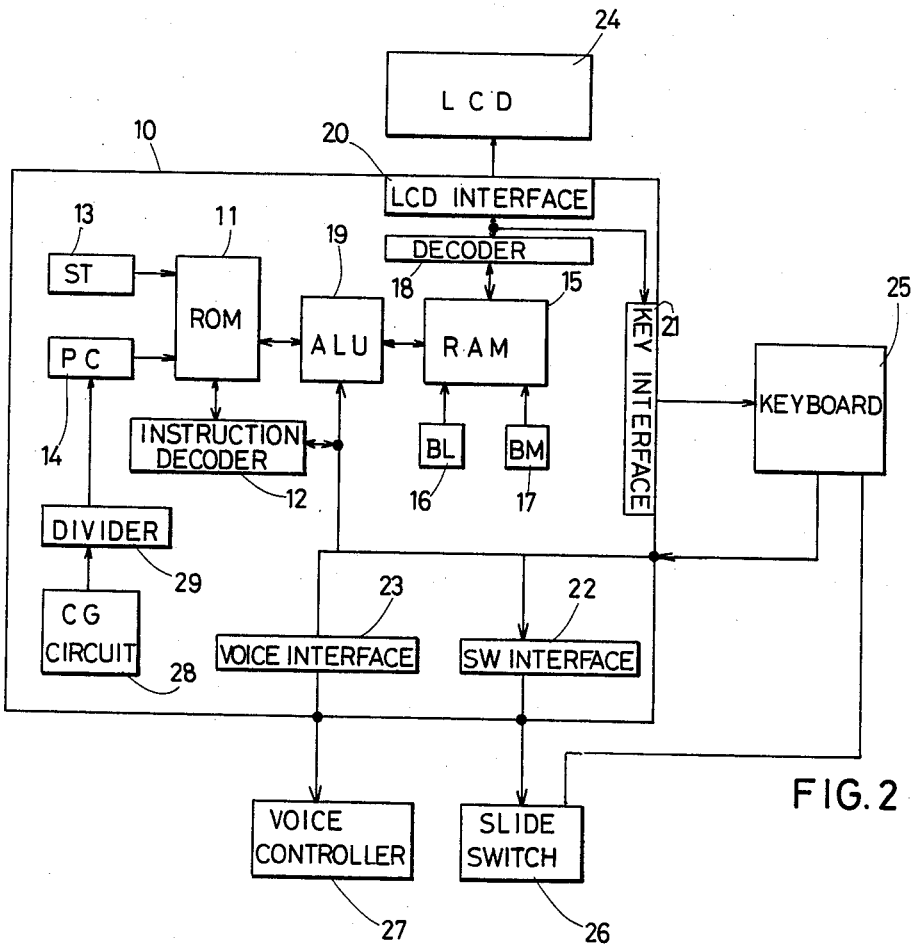
FIG. 2 shows a simplified block diagram of the system control circuits of a multi-alarm message timepiece according to the present invention.

FIG. 2 shows a simplified block diagram of the circuitry of the alarm message timepiece embodied by the present invention. Symbol 10 represents an LSI which contains read-only memory (ROM) 11, instruction decoder 12, subroutine stack (ST) 13 needed for the program execution, and the program counter (PC) 14 needed for the program addresses, where all of these make up the controller of the alarm message timepiece of the preferred embodiment of the present invention.

Read-write memory (RAM) 15, BL register (BL) 16 that designates the figure of RAM 15, the data pointer BM register (BM) 17 that designates the file of RAM 15, and decoder 18, jointly make up the memory of the alarm message timepiece embodying the present invention.

The alarm message timepiece is provided with an arithmetic operation unit 19 that executes a variety of the arithmetic operations of the talking alarm timepiece, an LCD interface 20, a key interface 21, a switching interface 22, and a voice interface 23, these interfaces being respectively connected to the external LCD 24, key unit 25 incorporating the time (hour/minute) correction key, slide switch 26 that incorporates the mode select switch, and the voice controller 27.

As shown in FIG. 2, the clock circuit (CG) 28 and the divider circuit 29 are respectively connected to the program counter (PC) 14. ROM 11 stores the program needed for executing a variety of operations related to the present invention so that a variety of the instructions can be correctly executed through the instruction decoder 12.

Figure 3:
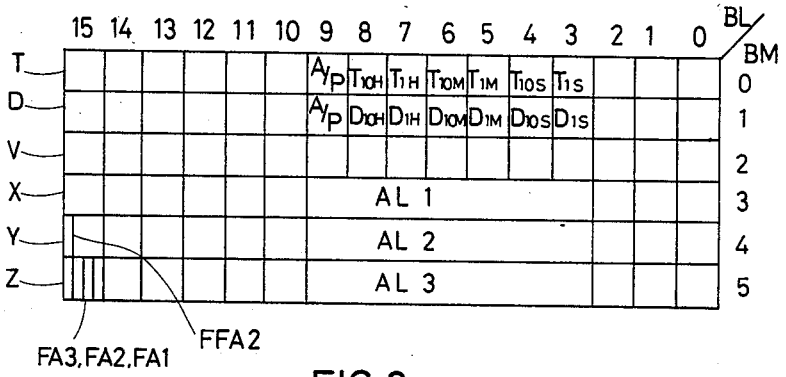
FIG. 3 shows a diagram of the read-write memory (RAM) built in the memory section of the multi-alarm message timepiece according to the present invention.

As shown in FIG. 3, RAM 15 incorporates a maximum of 6 registers, X, Y, Z, T, D, and V, each having a maximum of 16 figures, where each register is used as the temporary memory and flag for memorizing and calculating a variety of data. During this operation, BL register 16 designates the figures of said 6 registers, while BM register 17 designates the filing of these figures. Symbol A/P represents an area where the data that distinguishes AM from PM is memorized. Symbol T represents the clock counter register, while the segment T1S is used for memorizing the 1 second figure, T10S for the 10 seconds figure, T1M for the 1 minute figure. T10M for the 10 minutes figure T1H for the 1 hour figure, and T10H for the 10 hours figure, respectively. Symbol D represents the display register.

AL1 is an area where the wake-up alarm time can be set, while AL2 represents an area where the study alarm time can be set, and AL3 represents an area where the go-to-bed alarm time can be set. FA1, FA2, and FA3 are respectively the flags representing the On/Off status of AL1, AL2, and AL3 alarm modes mentioned above, whereas FFA2 is a flag representing that the first message of the study alarm has been verbally output.

Figure 4:
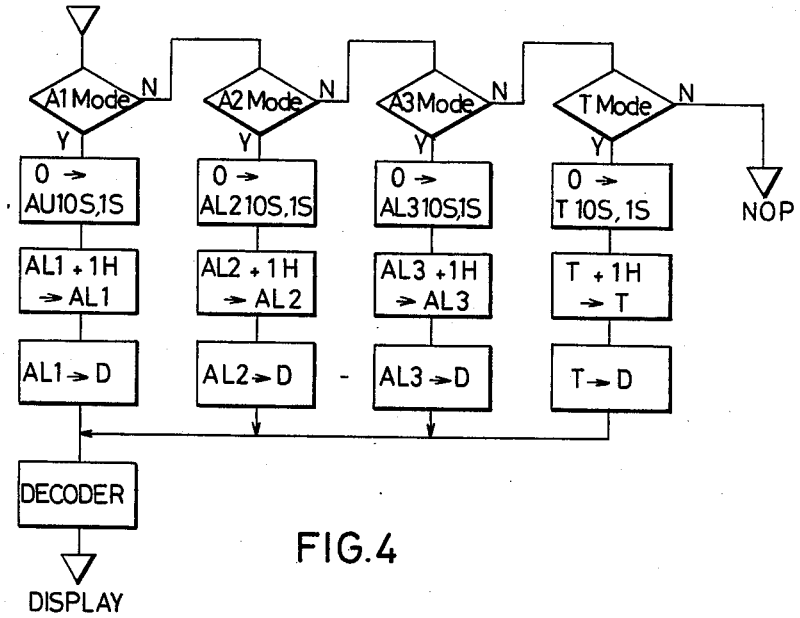
FIGS. 4 through 8 respectively show flow charts describing the operations of respective controllers.

FIGS. 4 through 8 respectively show flow charts describing procedures to be executed by respective controllers. FIG. 4 shows the control mode when the time (hour) key is pressed. If the symbol select key 5 remains in the A1 (wake-up alarm) mode, it resets the secondwise figure of the A1 mode and counts up the hour figure. This data is transmitted to the display register D, where the data is decoded for display. In other words, whenever the hour key is pressed, the hour is counted up.

Likewise, if the symbol selection key 5 remains in the A2 (study alarm) mode, it resets the secondwise figure of the AL2 mode. Then, the hour figure is counted up so that the AL2 mode can be displayed. The AL3 mode (go-to-bed alarm) can be processed by the same procedures as described above.

To set the actual time, the symbol select key 5 is first set to the symbol 8 position and then the time key is pressed so that the time figure of the actual time can be counted up. On the other hand, if the symbol select key 5 remains in the symbol 9 position, i.e., in the Normal mode, no operation can be executed at all.

Figure 5:
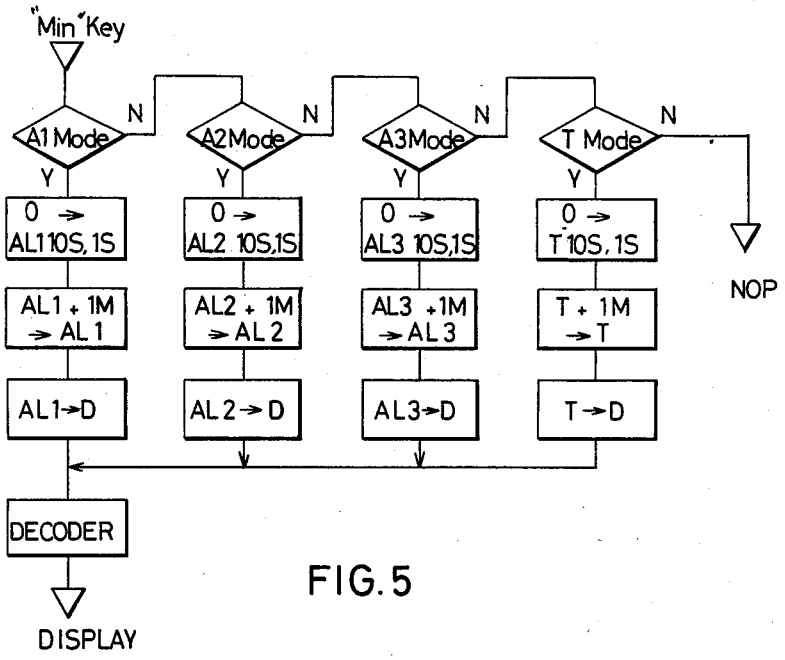

FIG. 5 shows the flow chart of the control mode when the minute key is pressed. Except that the count-up operation applied to the minute figure rather than the hour figure, all the operations are identical to those shown in FIG. 4.

Figure 6:
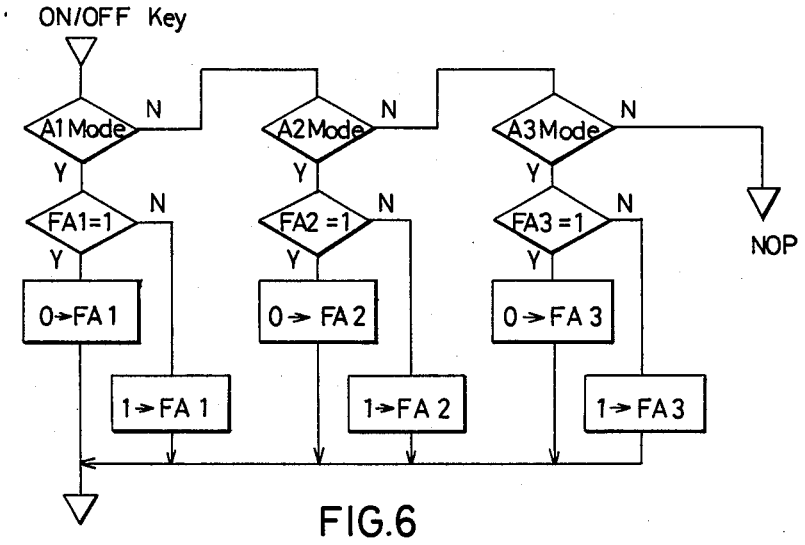

FIG. 6 shows the flow chart for controlling the operation of the alarm On/Off key. When the symbol selection key 5 remains in the A1 mode, operation of the On/Off key inverts the state of flag FA1. When the slide switch remains in the A2 mode, it inverts flag FA2. Likewise, when the symbol select key 5 remains in the A3 mode, it inverts the state of FA3. In other words, each of these alarm modes can be turned On/Off by effect of the operation mentioned above.

Figure 7:
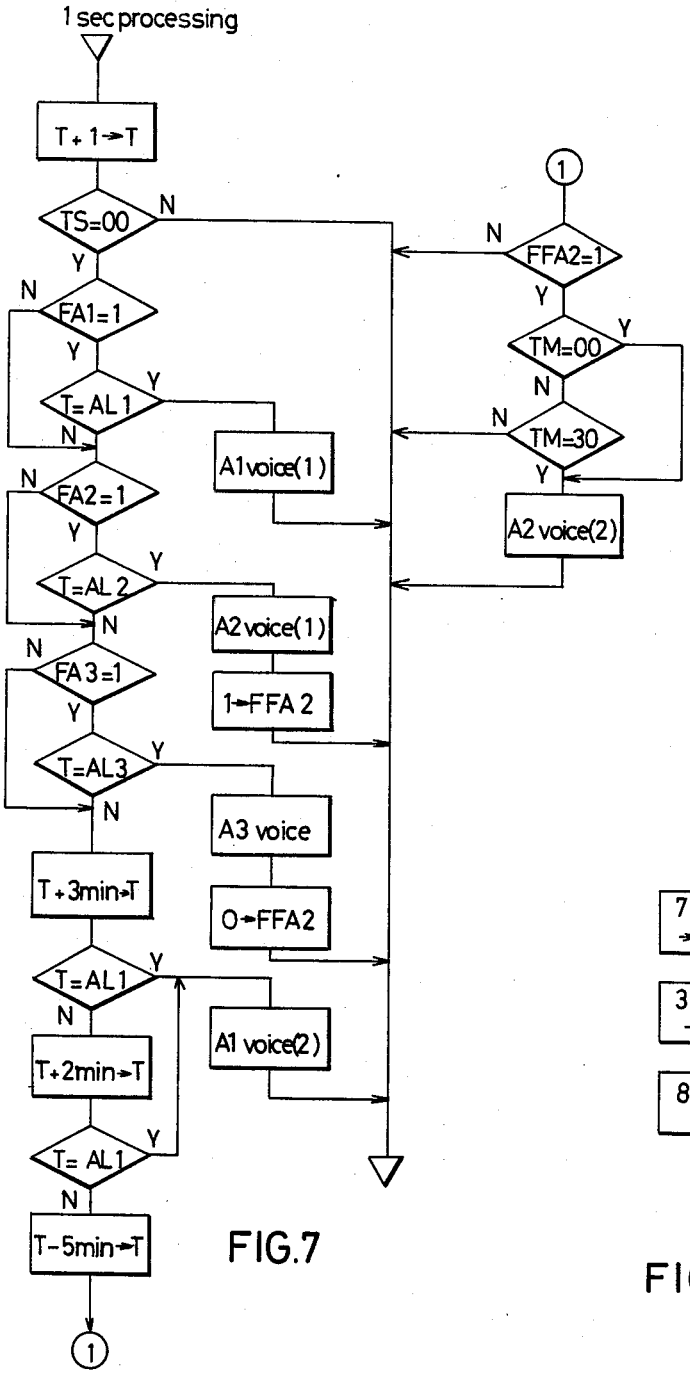

FIG. 7 shows the flow chart for executing the one-second signal processing operation.

When the one-second signal is generated, register T counts up one second. As soon as the secondwise figure displays 00 seconds, each of the alarm modes is then processed. When 00 seconds display remains in the figure, the controller compares the alarm times and the three flags, FA1, FA2, and FA3, with the actual time. For example, if the actual mode is FA1=1, and T=AL1, a melody is first output as the beginning message for the wake up alarm, and then a verbal message saying "good morning, it's 00 (for example, six thirty) now" is verbally output. If the actual mode is FA2=1, and T=AL2, a series comprising the initial chime, a verbal message saying "it's high time to study", and a melody will be sequentially output. During this operation, flag FFA2 remains set.

Likewise, if the actual mode is FA3=1, and T=AL3, a "go-to-bed" alarm message composed of the initial chime, a verbal message saying "it's high time to go to bed", and a melody will be sequentially output.

The alarm message timepiece embodied by the present invention is particularly useful when making a wake-up alarm call. It not only talks to the sleeper by one round of the wake-up call, but it also repeats urging him to wake up by generating the second and third rounds of the wake-up call messages two minutes and five minutes later. T+3 minutes, T+2 minutes, and T+5 minutes shown in FIG. 7 are respectively the procedures needed to execute such wake-up calls.

When making a study alarm call, the alarm message clock verbally repeats the second message saying "have you already finished your study?" at intervals of every 30 minutes, at every hour and half hour until flag FFA2 is reset. FFA2 will also be reset as soon as the alarm confirmation key is operated.

Figure 8:
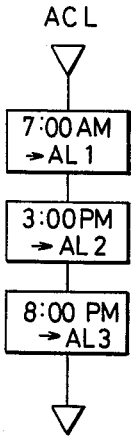

FIG. 8 shows the initial procedures when the battery is loaded into the alarm message clock. In other words, when the battery is loaded, first, each register is automatically cleared, and then certain time data corresponding to each preset alarm message is automatically set in the AL1 through AL3 alarm modes. Therefore, unless any change of such times is actually required, it is not necessary to actually take steps to input the time data.

As described above, the multi alarm message clock embodied by the present invention is characterized in that; it can activate any desired alarm message corresponding to the designated function, as identified by a symbol by merely setting a specific time and by activating the alarm-On mode while positioning the mode select key to the designated symbol for selecting the actually needed alarm message. As a result, any desired alarm message can be readily selected and set.

Another distinguishing advantage of the present invention is characterized in that; by using only the alarm On/Off key, the alarm system can correctly determine whether it should output any specific alarm message. The present invention can provide an extremely compact electronic timepiece at a very low cost.

A still further advantage of the alarm message timepiece of the present invention is characterized in that; when the battery is loaded, the alarm message timepiece automatically sets certain time data corresponding to each of the alarms all at once, and so it saves the individual the time data setting operations otherwise needed, which also effectively prevents such time data from being incorrectly set.

Figures 9, 10:
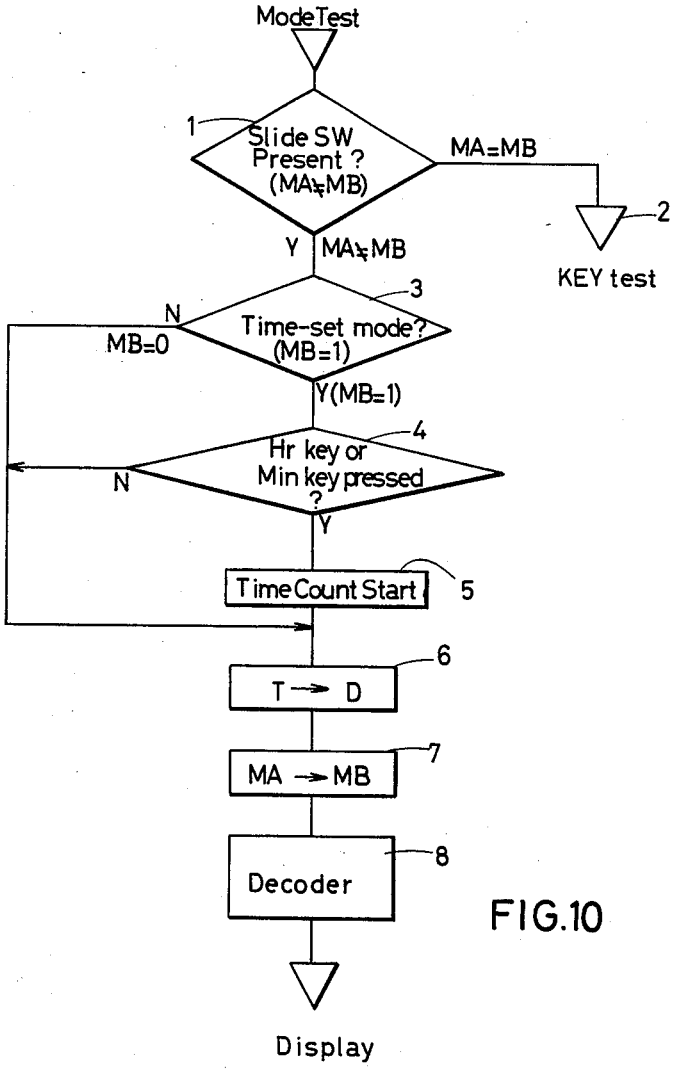
FIG. 9 shows a diagram of the read-write memory (RAM) built in another preferred embodiment of the present invention.
FIG. 10 shows a flow chart describing the operation of the read-write memory (RAM) shown in FIG. 9.

Another preferred embodiment of the present invention is described below. As shown in FIG. 9, RAM 15 is provided with a maximum of 6 registers, X, Y, Z, T, D, and V, each having a maximum of 16 figures, where each of these registers is used as the temporary memory and flag for memorizing and calculating a variety of data. During these operations, BL register 16 designates the figures of said registers, while BM register 17 designates the filing of these figures. Note that register MA preserves the existing mode, whereas register MB preserves the previous mode, and so both of these are used for preserving modes.

Symbol T represents the clock counter register, whereas segment T1S is used for memorizing the 1 second figure, T10S for the 10 seconds figure, T1M for the 1 minute figure, T10M for the 10 minutes figure, T1H for the 1 hour figure and T10H for the 10 hours figure, respectively. Symbol D represents the display register.

FIG. 10 shows the flow-chart describing the operational procedures when the alarm message clock enters the Normal mode from the time-set mode after correcting the hour and minutes. In reference to the flow chart shown in FIG. 10, details of the operations are described below.

First, the system controller detects (step 1) whether the existing mode has been switched to either the time-set or Normal mode by the mode select switch. In other words, it is detected whether the contents of registers MA and MB of RAM 15 are identical to each other. If they are identical, the system controller then determines that the mode remains unchanged (i.e., the mode select switch has not been operated), and so the operation jumps to the key test routine (step 2). If the contents of registers MA and MB are not identical to each other (i.e., the mode select switch has been operated), the operation then proceeds to step 3 in order to determine whether the processing mode is the time-set mode.

If the contents of register MB remains in the state represented by "1", the controller then determines that the preceding mode was the time-set mode, and then the controller determines that the mode has actually been switched to the Normal mode from the time-set mode, thus enabling the operation to proceed to the next step 4, where it is detected whether the hour or minute correction key was operated while in the time-set mode.

If either the hour or minute correction key was pressed, during the next step 5, the time counting operation is then executed starting from the point of the time correction, and then the hour-minutes-seconds data stored in the clock counting register T of RAM 6 is fed to the display register D during the next step 6. Then, the contents of register MA are transmitted to register MB during the next step 7.

Finally, during the next step 8, the hour-minutes-seconds data stored in the display register D is decoded, so that display 24 can sequentially display the time starting from the time corrected according to the time count operation being conducted. During the preceding step 3, if the contents of register MB are determined to be "0", i.e., when the Normal mode is switched to the time-set mode and also when the time-set mode is switched to the Normal mode without executing the time correction, then the operation directly proceeds to step 6, and as a result, time display can be executed.

As described above, after the time correction is executed during the time-set mode, if the Normal mode is entered from the time-set mode, the time counter will start its count-up operation from the time corrected in order to display the actual time. Even when the existing mode is being switched by means of the mode select switch without operating the time correction key, the time counting operation can be continuously executed without any adverse effect so that the actual time can be correctly displayed.

The present invention thus described with reference to the annexed drawings may easily be suggestive of a variety of derivations and/or modifications to those skilled in the art. It should be understood, however, that the present invention is not limited to that which is described above, but is intended to include all of such derivations and/or modifications within the spirit and scope of the following claims.

What is claimed is:

1. An electronic timepiece comprising:

message storing means for storing data representing a plurality of predetermined alarm messages;

output means operatively associated with said message storing means for outputting any of said messages in the form of audible messages; and control means for said timepiece, said control means consisting essentially of:

a mode selecting switch for selectively setting said timepiece in any of a plurality of alarm modes, a time correcting mode, and a normal timekeeping mode;

a time setting switch means cooperable with said mode selecting switch in each of said alarm modes for setting an alarm time for each of said alarm modes;

said time setting switch means being further cooperable with said mode selecting switch in said time correcting mode for adjusting the actual time displayed by said timepiece and inoperative in said normal mode; and a sole additional switch cooperable with said mode selecting switch in each of said alarm modes for selectively activating each of said alarm modes; said sole additional switch being inoperative in said time correcting mode and said normal mode;

said mode selecting switch and said sole additional switch being jointly operable to selectively activate any or all of said plurality of alarm modes for selectively activating said output means to output any or all of said plurality of messages from said message storage means associated with said respective alarm modes.

2. An electronic timepiece as in claim 1, wherein said timepiece is battery operated and further comprises means for setting an alarm time for each of said plurality of alarm modes upon insertion of a battery into said timepiece without operation of said mode selecting switch or said time setting switch means.

* * * * *